US006705927B2

(12) United States Patent
Horie et al.

(10) Patent No.: US 6,705,927 B2
(45) Date of Patent: Mar. 16, 2004

(54) METHOD OF PRODUCING MAGNETIC HARD DISK SUBSTRATE WITH TEXTURED SURFACE

(75) Inventors: Yuji Horie, Tokyo (JP); Hiromitsu Okuyama, Tokyo (JP)

(73) Assignee: Nihon Microcoating Co., Ltd., Tokyo (JP)

( * ) Notice: Subject to any disclaimer, the term of this patent is extended or adjusted under 35 U.S.C. 154(b) by 5 days.

(21) Appl. No.: 10/166,492

(22) Filed: Jun. 10, 2002

(65) Prior Publication Data

US 2003/0022600 A1 Jan. 30, 2003

Related U.S. Application Data

(62) Division of application No. 09/461,271, filed on Dec. 15, 1999, now Pat. No. 6,439,976.

(51) Int. Cl.[7] ..... B24B 1/00

(52) U.S. Cl. ..... 451/59; 451/41; 451/36; 451/527

(58) Field of Search ..... 451/36, 41, 59, 451/57, 28, 60, 304, 307, 302, 299, 550, 533, 539; 51/308; 428/314.2, 317.9, 304.4

(56) References Cited

U.S. PATENT DOCUMENTS 5,209,027 A * 5/1993 Ishida et al. ..... 451/41
5,586,926 A * 12/1996 Wedell et al. ..... 451/59
5,702,291 A * 12/1997 Isobe ..... 451/41
5,868,806 A * 2/1999 Nishio et al. ..... 51/297
5,885,143 A * 3/1999 Ichikawa et al. ..... 451/168
5,899,794 A * 5/1999 Shige et al. ..... 451/41
6,062,968 A * 5/2000 Sevilla et al. ..... 451/526
6,074,284 A * 6/2000 Tani et al. ..... 451/57
6,126,515 A * 10/2000 Horie et al. ..... 451/36
6,315,638 B1 * 11/2001 Marukawa ..... 451/36
6,419,556 B1 * 7/2002 Urbanavage et al. ..... 451/41

* cited by examiner

*Primary Examiner*—Joseph J. Hail, III
*Assistant Examiner*—Anthony Ojini
(74) *Attorney, Agent, or Firm*—Beyer Weaver & Thomas LLP

(57) ABSTRACT

A polishing tape makes use of a foamed material such as polyurethane foam attached to a plastic backing material. The foamed material is elastic and some of its gas holes formed inside but near one of its surfaces are exposed externally. Because of its elastic nature, it can be deformed even if there are abnormally large abrading particles contained in a liquid slurry and such abrading particles do not become embedded in the target surface being textured. These externally exposed gas holes can also serve to absorb the debris generated by the texturing and to protect the target surface from being scratched thereby. Such a tape is used for a texturing process while dropping a liquid slurry containing abrading particles and rotating the disk substrate and pressing the tape against the target surface.

1 Claim, 7 Drawing Sheets

FIG._2

METHOD OF PRODUCING MAGNETIC HARD DISK SUBSTRATE WITH TEXTURED SURFACE

This is a division of application Ser. No. 09/461,271 filed Dec. 15, 1999 now U.S. Pat. No. 6,439,976.

BACKGROUND OF THE INVENTION

This invention relates to a method of producing a magnetic hard disk substrate with a textured surface by using a polishing tape.

With the recent development in the so-called high-tech industries centered around the electronics industries, memory capacity of magnetic disks is becoming higher and there is an increasing demand for high precision in the finishing of disk substrate surfaces. If a magnetic head is stopped on a magnetic disk thus structured, however, the magnetic head may be adsorbed to the magnetic disk due to the water component or a lubricant adsorbed to the disk surface. In order to prevent such occurrence of adsorption, it has been known to carry out a texturing process to form fine concentric protrusions and indentations on the surface of magnetic hard disk substrates in the circumferential direction of the substrate. The texturing process is usually carried out by using a polishing tape obtained by coating the surface of a backing material (say, of polyester) with abrading particles (say, of white molten alumina) or a slurry obtained by dispersing such abrading particles in a liquid.

Prior art abrading particles such as prior art alumina particles for abrading are not uniform in sizes or shapes, there being great variations and some of the larger particles protruding from the polishing surface of the tape. If a target surface is polished by means of such a tape, large particles tend to grind the target surface too deeply, leaving undesirably tall scratch marks on the surface.

As the recording density on the magnetic disk is increased, the height of the magnetic head over the magnetic disk must be reduced in order to improve the signal sensitivity at the time of recording and reproduction, reducing the distance of separation therebetween. If there are protrusions sufficiently high on the substrate surface, however, the magnetic head may collide with such a protrusion (an event referred to as the "head hit"). If the texturing is carried out intentionally insufficiently in order to prevent the generation of protrusions, however, the magnetic disk will end up being too smooth on the surface and the adsorption to the head will result, as described above.

Even if the texturing is carried out by using a liquid slurry serving as free abrading particles, similar problems are encountered as long as there are variations in the sizes and shapes of the abrading particles. If the texturing process is done only lightly in fear of the occurrence of head hit, one again faces the problem of adsorption of the disk to the magnetic head.

Japanese Patent Application 8-88954 disclosed a type of tape produced by applying a adhesive on the surface of a plastic tape and planting piles of 6-nylon, 66-nylon, vinylon or polyester thereon. Since plastic tapes have a uniform thickness and a flat surface, piles can be planted uniformly and at a high density. Thus, a very fine and uniform texturing process is possible with such a polishing tape. There is a problem, however, with this type of polishing tapes in that the planting of the piles becomes difficult if the piles are too short. For this reason, there have been attempts to produce a woven polishing tape by combining longitudinally and transversely extending fibers.

In the meantime, there has been a demand to increase the memory capacity of the disks. A fine surface roughness can be attained by using tapes with planted piles or woven tapes if fibers with small diameters are used.

Recently, however, the surface roughness is coming to be required to be even smaller than possible by reducing the thickness of the fibers. In other words, the era of tapes with planted piles and woven tapes seems to be coming to an end. In addition, tapes of these kinds require the use of a liquid slurry, there remaining the problem of producing unwanted protrusions on the target surface or having the abrading particles themselves embedded in the target surface. Another problem with the use of a liquid slurry is that the debris particles resulting from the grinding are carried around throughout the polishing process. Thus, the target surface may be damaged by such debris. Scratches produced thereby and the embedded debris themselves are both likely to cause the head hit. Still another problem of such prior art texturing processes is that the debris produced by the grinding must be removed afterwards and hence that it is time-consuming.

SUMMARY OF THE INVENTION

It is therefore an object of this invention to provide a method of producing a magnetic hard disk substrate with a textured surface by using a polishing tape with which smaller surface roughness can be attained in response to the recent demand for higher capacities of hard disks while obviating the problem of head hit.

A polishing tape to be used in a method embodying this invention, with which the above and other objects can be accomplished, may be characterized as comprising a backing material and a foamed material such as polyurethane foam. The foamed material is elastic and some of its gas holes formed inside but near one of its surfaces are exposed externally. Because of its elastic nature, it can be deformed even if there are abnormally large abrading particles contained in a liquid slurry and such abrading particles do not become embedded in the target surface being textured. These externally exposed gas holes can also serve to absorb the debris generated by the texturing and to protect the target surface from being scratched thereby. Such a tape is used for a texturing process while a liquid slurry containing abrading particles is dropped, the disk substrate is rotated and the tape is pressed against the target surface.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
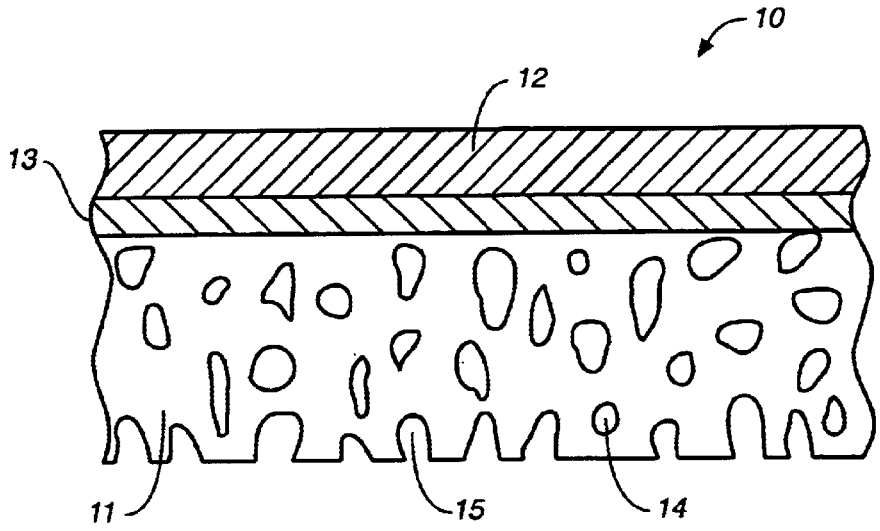
FIG. 1 is a schematic sectional view of a portion of a polishing tape embodying this invention.

As shown schematically in FIG. 1, a polishing tape 10 according to this invention comprises a foamed material 11 and a base material 12 for backing attached together by means of an adhesive 13. The foamed material 11 may comprise polyurethane produced by a reaction between isocyanate and polyester having functional hydroxyl group. If water is added in this reaction under certain conditions, carbon dioxide gas is generated. If the gas thus generated is sufficiently stirred and dispersed into the material, care being taken until the material hardens such that the gas will not escape from the material, a foamed material of polyurethane can be obtained. (See, for example, the Handbook of Plastic Forming Processes, Fourth Edition, published by the All-Japan Plastic Forming Industry Association.) The foamed polyurethane layer according to this invention is preferably 0.1–0.5 mm in thickness, 20–50 degrees in Shore hardness, 5–40% in compressibility at temperature 20° C. and humidity 65°, and 70–100% in compressive elasticity. The base material 12 may be polyester, polyethylene terephthalate (PET) or polyvinyl chloride (PVC). Its thickness is preferably 25–500 $\mu$m. The base material serves as a backing material, as explained above, to prevent the foamed material 11 from expanding. As for the adhesive 13, any conventional adhesive such as thermoplastic resin, thermosetting resin or resins which harden by ultraviolet radiation may be used but water-soluble polyurethane resin adhesives are preferable. Pure water is a preferred solvent for dissolving and diluting the adhesive. It is also preferable to dissolve a solution such as alcohol and ketone by 3–10%.

To produce the tape 10 according to this invention, the foamed urethane is prepared as described above and hardened in the form of a film containing many individual air bubbles (or foams). At the moment, the empty spaces of the bubbles do not appear on the surface. Next, one of its surfaces is removed by means of a piece of sandpaper or the like such that those of the air bubbles near the surface (indicated by numeral 14) come to be exposed. Lastly, one of the surfaces of the foamed polyurethane 11 is coated with the adhesive 13 and the polyester film 12 is attached thereto.

Figure 2:
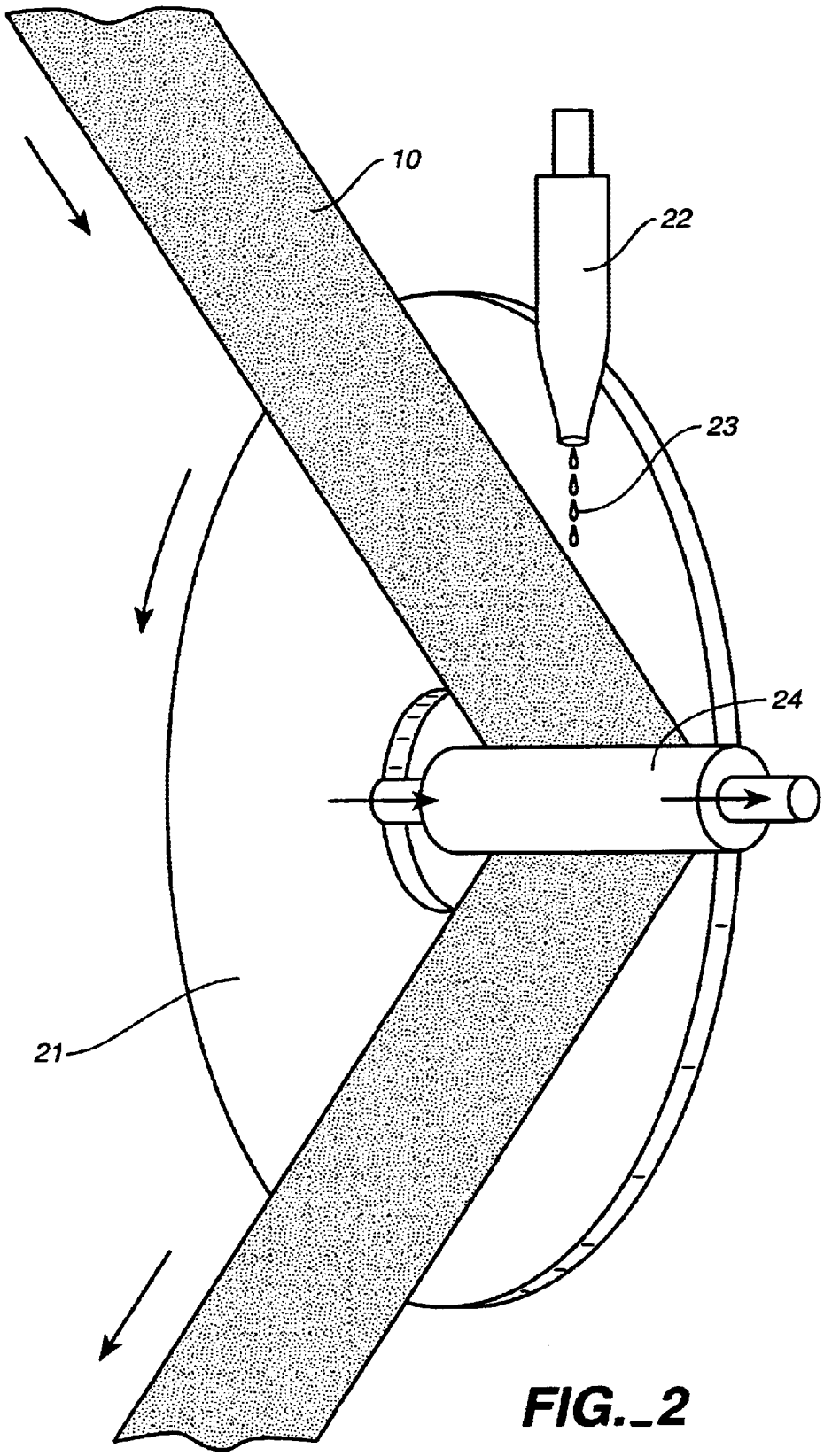
FIG. 2 is a sketch of a texturing process with the use of a polishing tape of this invention.

The polishing tape 10 of this invention thus produced may be used as shown in FIG. 2, being pressed on the surface of a rotating magnetic hard disk substrate 21 through a rubber roller 24 while a liquid slurry 23 serving as free abrading particles is dropped from a nozzle 22 and the tape 10 itself is caused to travel over the disk surface in a direction opposite to that of the rotation of the disk substrate 21. The liquid slurry may be of a conventional type such as having abrading particles of alumina, aluminum oxide, silicon carbide or diamond mixed and stirred with a water-soluble liquid containing a surfactant.

By using a polishing tape according to this invention, comprising a foamed material, it is possible to obtain a good result of texturing as obtainable by using uniform abrading particles and to attain much smaller surface roughness than previously possible. Another advantage of using a polishing tape of this invention is that the processes of grinding and texturing can be carried out simultaneously and hence it is more effective while these processes were carried out in two separate steps previously. This has become possible because the surface roughness attainable by the tape of this invention is finer than that of the original disk such that when the disk substrate is rotated for providing concentric scratches, a same degree of surface roughness obtainable by the polishing can be obtained. Still another advantage of the tape of this invention is that many holes created by gas bubbles are exposed on its polishing surface. Thus, the debris generated by the grinding are absorbed into them as soon as they are generated. Since the grinding continues while removing the debris being generated, the target surface is not damaged by the debris. Since the extra step of removing the debris after the completion of the polishing, the work efficiency is thereby improved. It now goes without saying that the liquid slurry can be easily washed with water and hence even those particles which failed to be removed by the tape can be washed away together with the liquid slurry. The polishing tape of this invention can be cut into any shape and hence no new texturing machine need to be designed.

Tapes FP504, FP404 and SW-16 (to be described below) with different degrees of granularity of abrading particles of diamond (respectively D6000, D8000 and D10000) and average particle diameters (respectively 2 $\mu$m, 1 $\mu$m and 0.5 $\mu$m) were used to texture disk substrates and the surface roughness resulting on the surfaces of each was measured and compared. Tapes FP504 and FP404 were products of Nihon Micro Coating Co., Ltd., produced by planting viscous cellulose piles of length 0.4 mm and thickness respectively 0.5 deniers and 0.4 deniers. Tape SW-16 was one produced according to this invention by adhesively attaching foamed polyurethane of thickness 0.5 mm, Shore hardness 62 degrees, compressibility 32% at temperature 20° C. and humidity 65°, and compressive elasticity 94% onto a polyethylene terephthalate film of thickness 50 $\mu$m. The original disk before any texturing is referred to as the "Blank". These tapes were used as shown in FIG. 1, being pressed onto the target surface with a force of 0.6–2.0 kg while liquid slurry obtained by mixing diamond abrading particles into a water-soluble liquid containing a glycol compound, higher aliphatic amide and a non-ionic surfactant and stirring the mixture together was dropped from the nozzle 22. Each texturing process lasted for 15 seconds.

Figure 3:
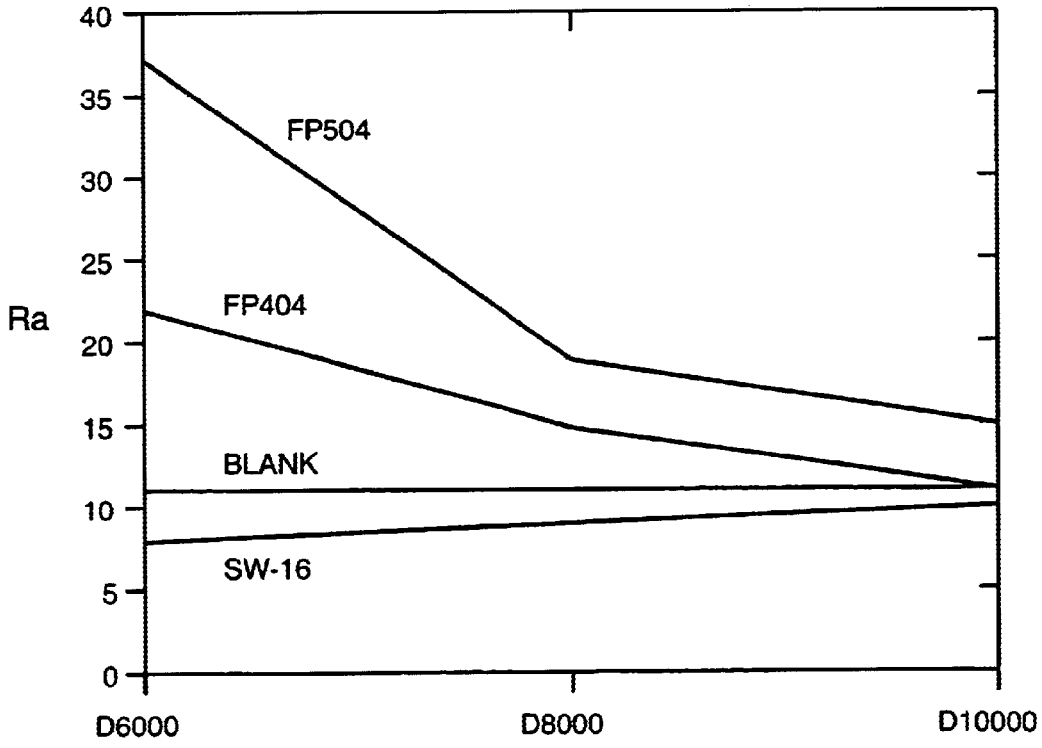
FIG. 3 is a graph which shows the results of texturing by using different kinds of tapes both embodying and not embodying this invention.

The surface roughness of each textured surface was measured by a device with a probing needle (Model P-1 produced by Tencol, Inc.). The results are shown in Table 1 and presented in a graphical form in FIG. 3. They show clearly that smaller surface roughness even than that of the original disk surface can be obtained by using a tape according to this invention.

TABLE 1

| | D6000 | D8000 | D10000 |
|---|---|---|---|
| Blank | 11 Å | 11 Å | 11 Å |
| FP504 | 37 Å | 19 Å | 15 Å |
| FP404 | 22 Å | 15 Å | 11 Å |
| SW-16 | 8 Å | 9 Å | 10 Å |

Figure 4:
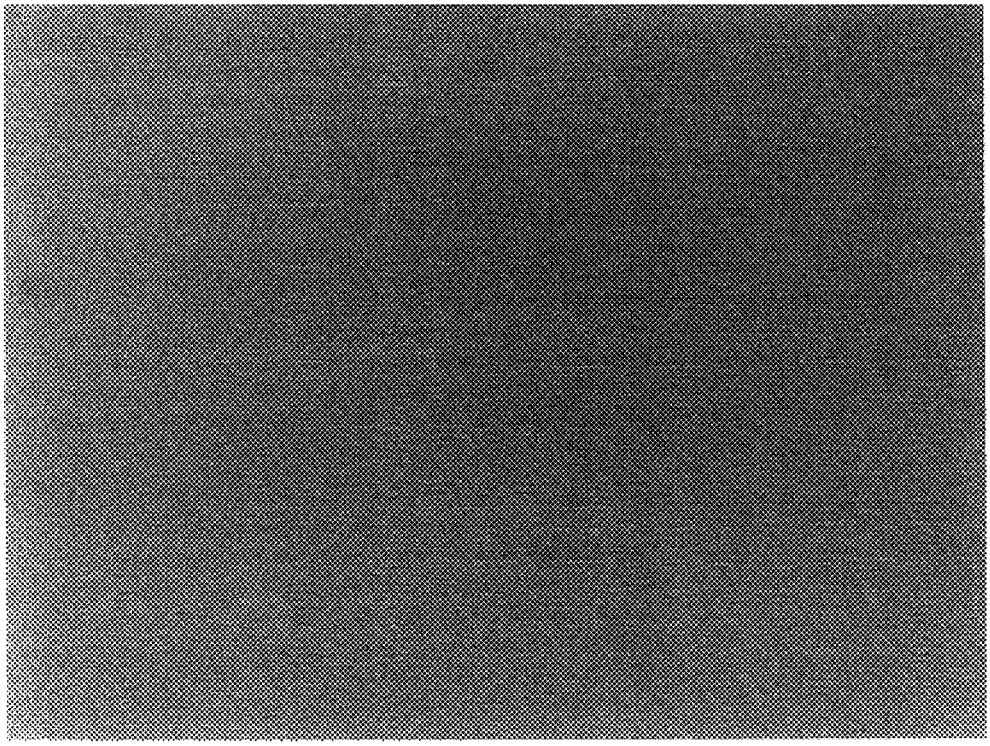
FIG. 4 is a photograph taken through an optical microscope of the untextured surface of an original disk (Blank") before it is textured.
Figure 5A:
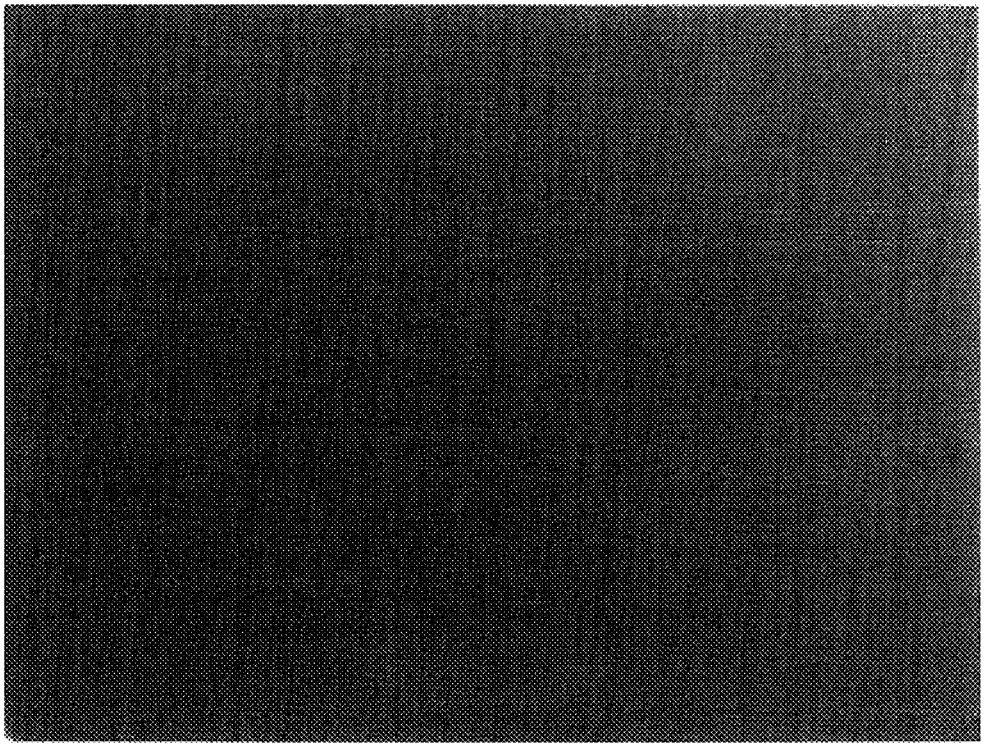
FIGS. 5(*a*), 5(*b*) and 5(*c*) are microscopic photographs of the surface of a disk respectively when prior art Tape FP504 with granularity D6000, D8000 and D10000 was used.
Figure 5B:
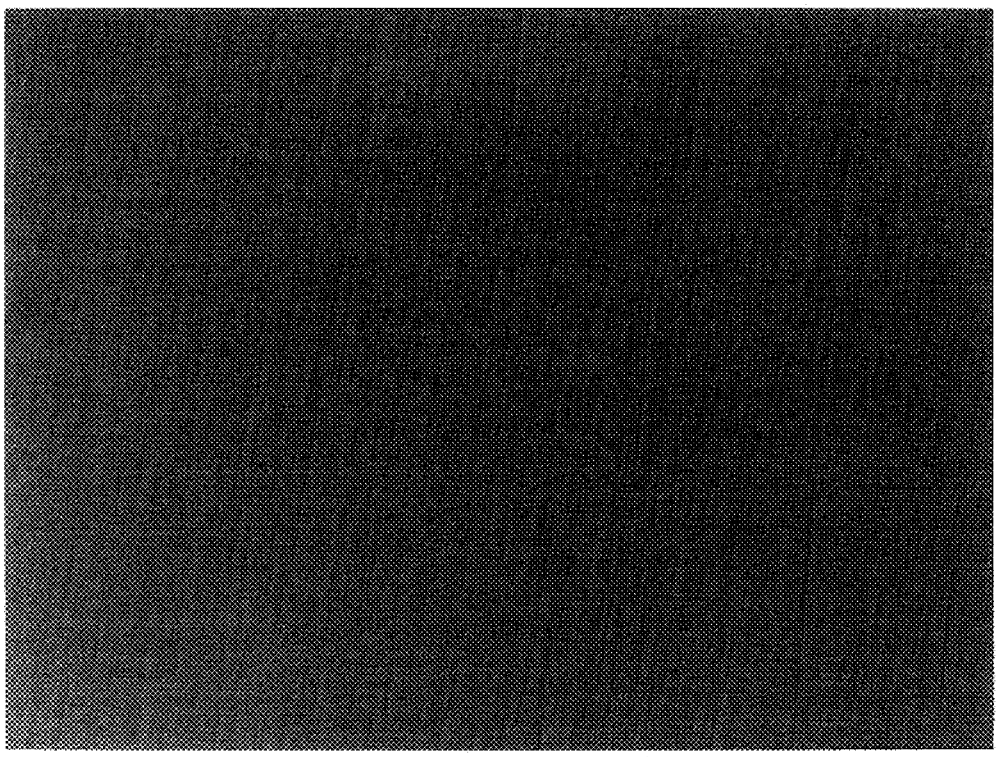
Figure 5C:
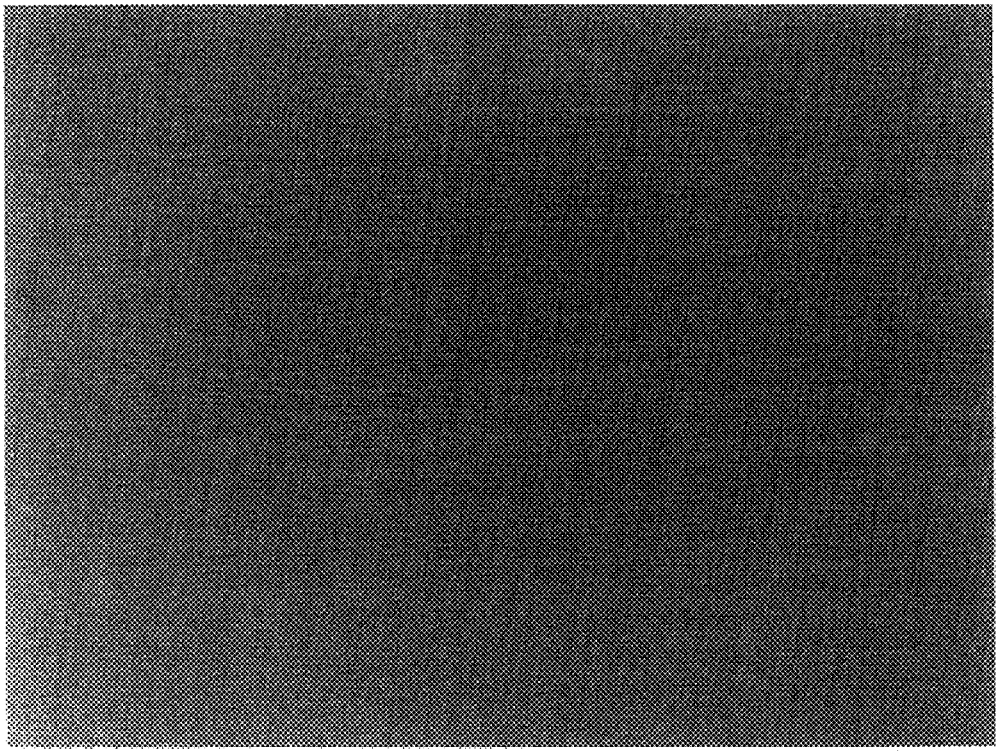
Figure 6A:
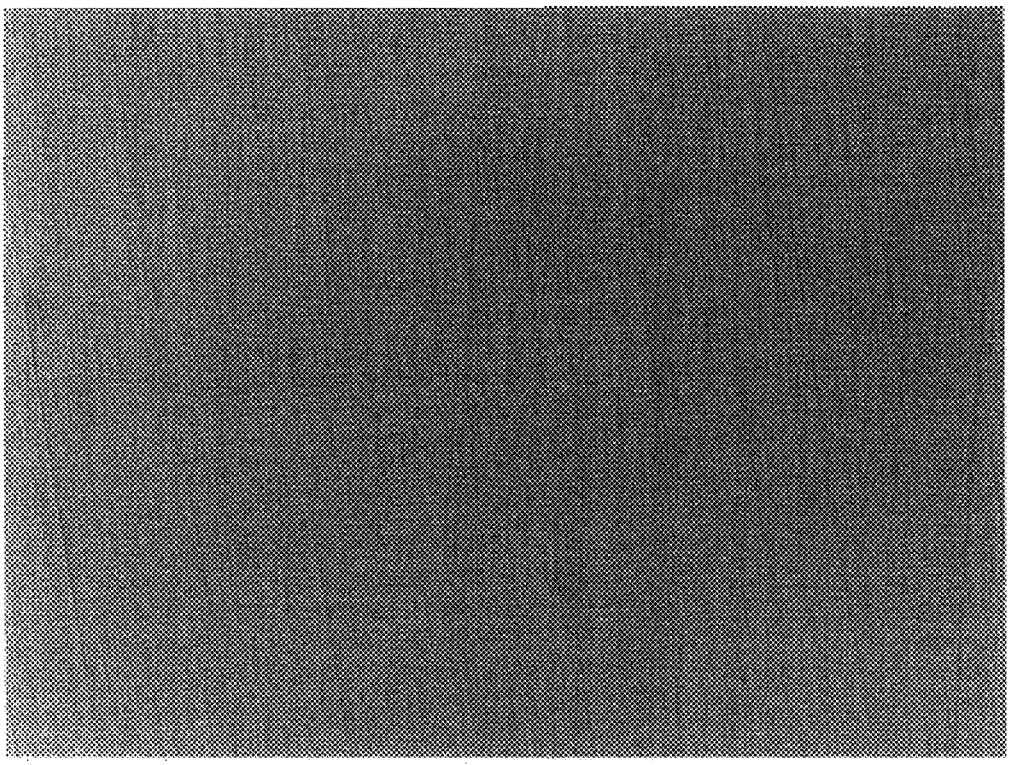
FIGS. 6(*a*), 6(*b*) and 6(*c*) are microscopic photographs of the surface of a disk respectively when prior art Tape FP404 with granularity D6000, D8000 and D10000 was used.
Figure 6B:
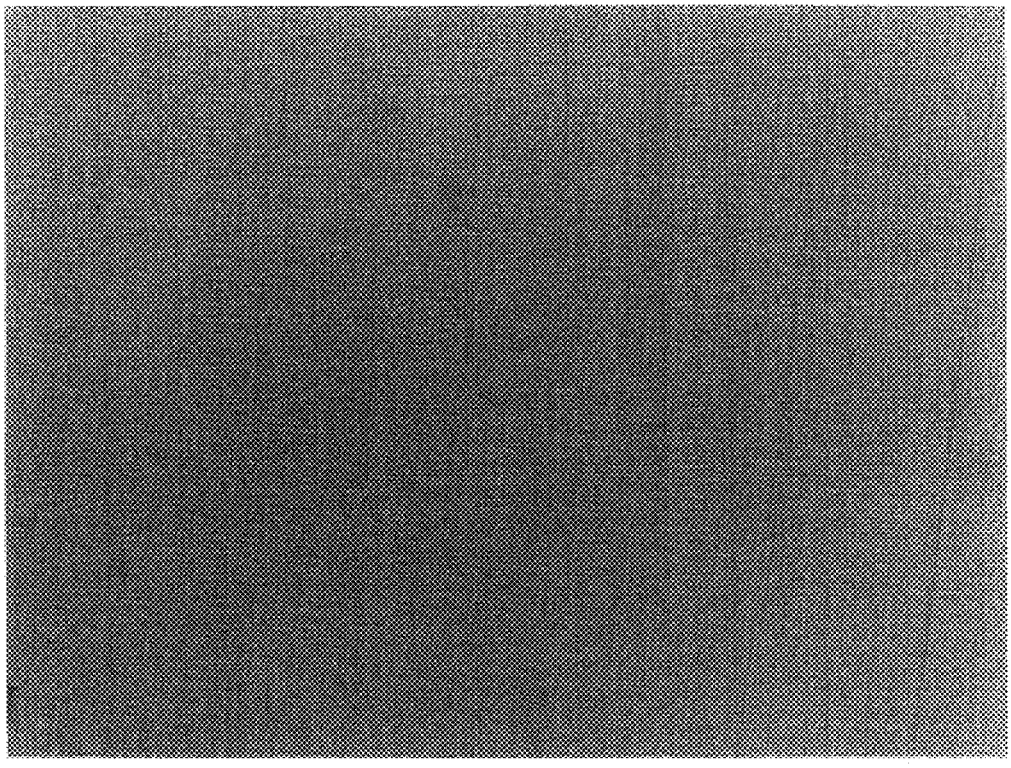
Figure 6C:
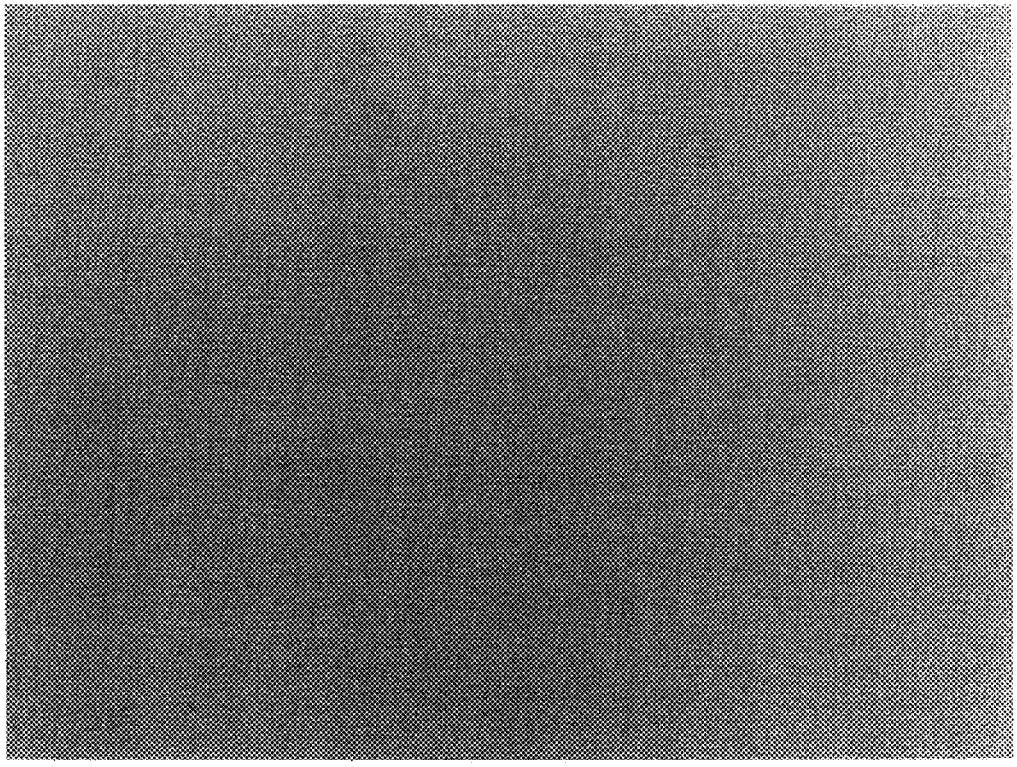
Figure 7A:
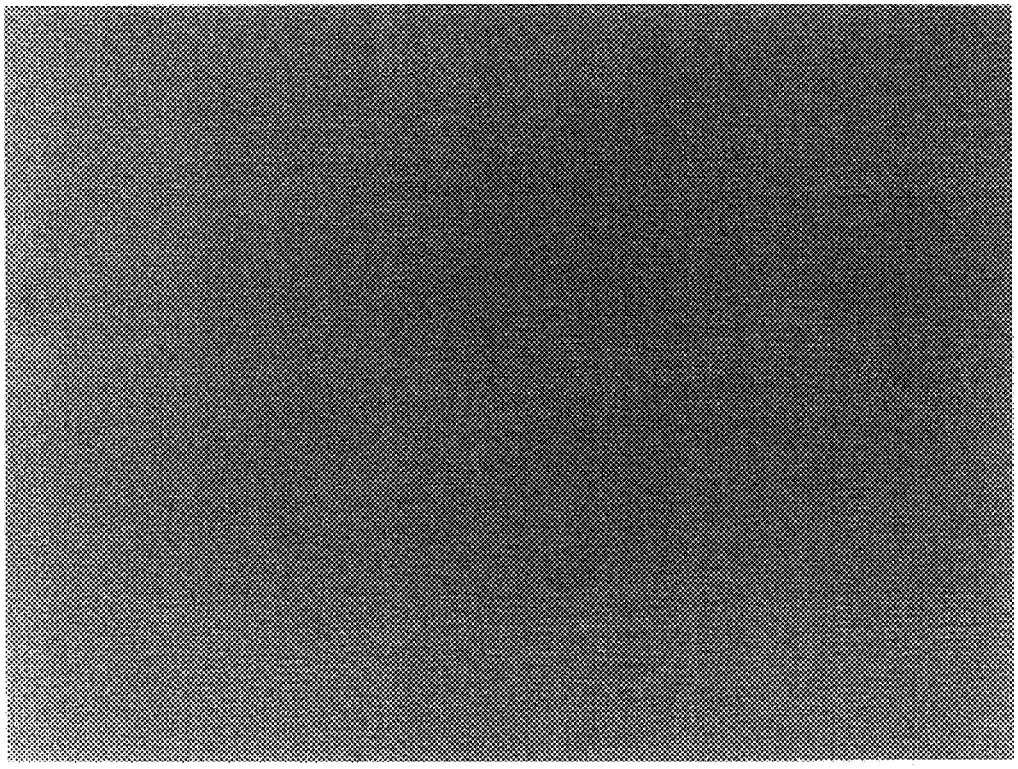
FIGS. 7(*a*), 7(*b*) and 7(*c*) are microscopic photographs of the surface of a disk respectively when Tape SW-16 according to this invention with granularity D6000, D8000 and D10000 was used.
Figure 7B:
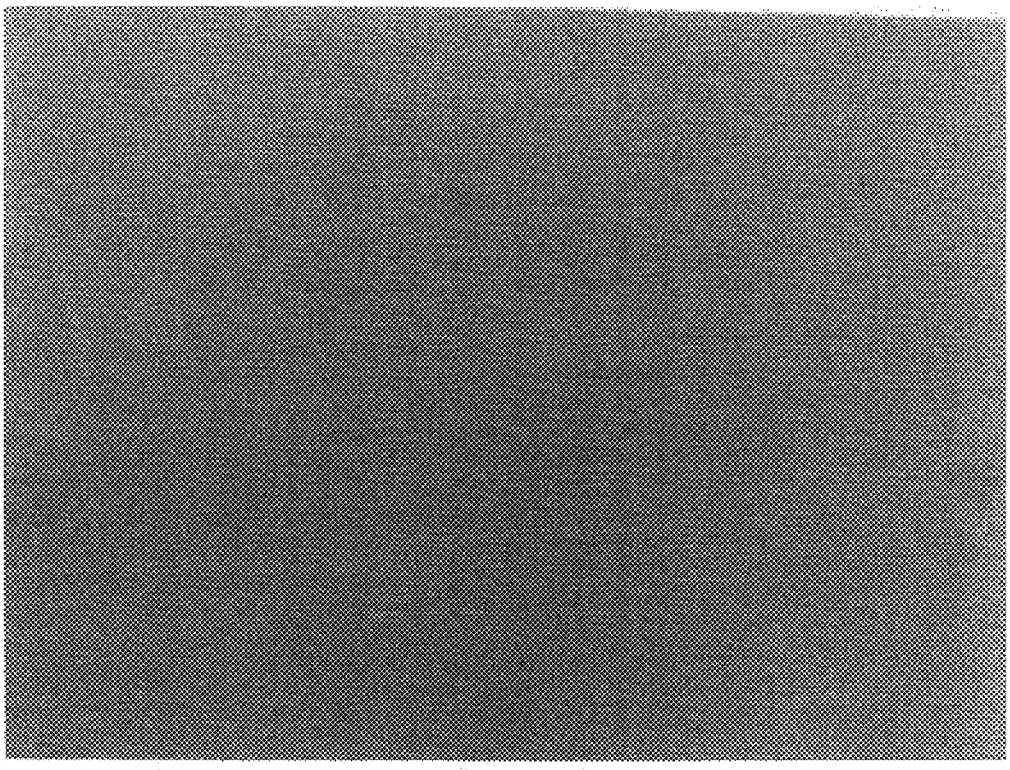
Figure 7C:
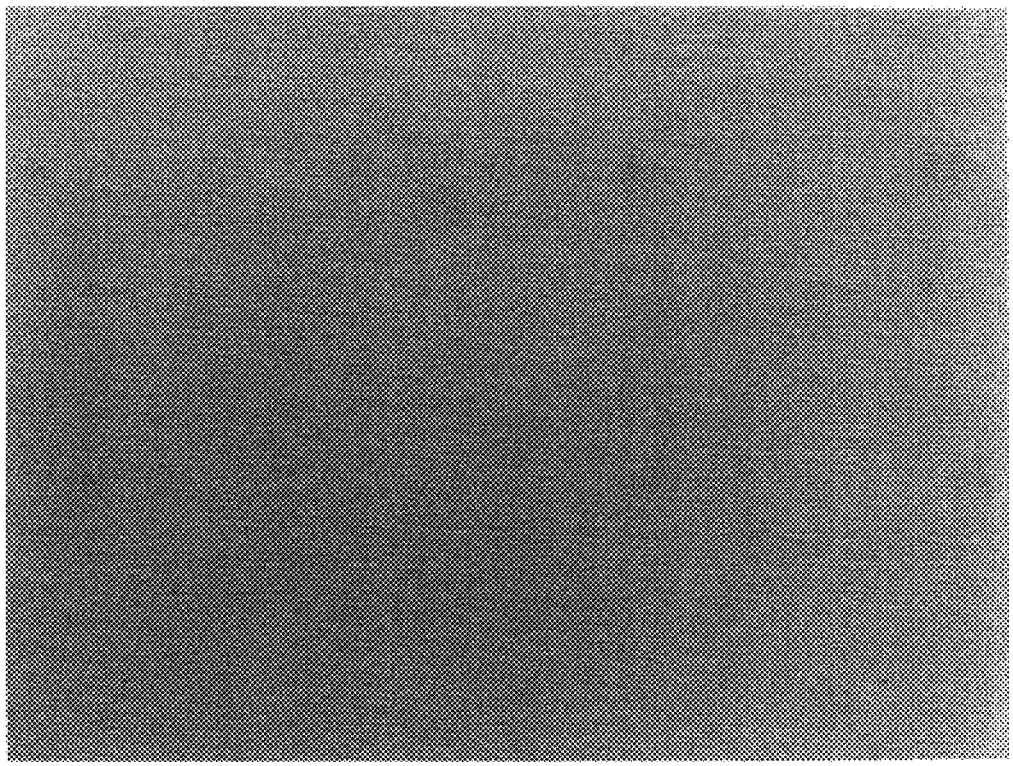

FIG. 4 is a photograph taken through an optical microscope of the surface of an original disk (Blank") before the texturing. FIGS. 5(*a*), 5(*b*) and 5(*c*) are similar microscopic photographs of the surface of a disk respectively when Tape FP504 with granularity D6000, D8000 and D10000 was used. FIGS. 6(*a*), 6(*b*) and 6(*c*) are similar microscopic photographs of the surface of a disk respectively when Tape FP404 with granularity D6000, D8000 and D10000 was used. FIGS. 7(*a*), 7(*b*) and 7(*c*) are similar microscopic photographs of the surface of a disk respectively when Tape SW-16 with granularity D6000, D8000 and D10000 was used.

These photographs show that scratches formed by the texturing are clearly visible in the case of Tapes FP504 and FP404 but the surface roughness in the case of Tape SW-16 according to this invention is so fine and cannot be observed visually. The surface roughness is even finer than that on the original disk (the "Blank").

What is claimed is:

1. A method of producing a magnetic hard disk substrate with a textured surface, said method comprising the steps of:

causing said disk substrate to rotate; and simultaneously pressing a polishing tape onto said surface, said polishing tape comprising a backing material and a polyurethane foam material having internal gas holes formed inside, said polyurethane foam material having a first surface on which some of said internal gas holes are externally exposed and a second surface which is attached to said backing material by an adhesive, said polyurethane foam material having thickness of 0. 1–0.5 mm, Shore hardness of 20–50 degrees, compressibility of 5–40% at temperature 20° C. and humidity 65° and compressive elasticity of 70–100%.

* * * * *